US007699403B2

(12) United States Patent
McCarthy

(10) Patent No.: US 7,699,403 B2
(45) Date of Patent: Apr. 20, 2010

(54) METHOD AND APPARATUS FOR MAKING TOOTHBRUSHES

(75) Inventor: Mark Norman McCarthy, Iowa City, IA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 11/489,905

(22) Filed: Jul. 20, 2006

(65) Prior Publication Data

US 2006/0255650 A1 Nov. 16, 2006

Related U.S. Application Data

(63) Continuation of application No. 10/358,740, filed on Feb. 5, 2003, now abandoned.

(51) Int. Cl.
*A46D 3/05* (2006.01)

(52) U.S. Cl. ..... 300/2; 300/11; 300/17; 451/260; 451/DIG. 916

(58) Field of Classification Search ..... 300/21, 300/11, 17, 18, 10, 217, 2–9; 451/260, DIG. 916; *A46D 03/05, 7/00, 9/00*
See application file for complete search history.

(56) References Cited

U.S. PATENT DOCUMENTS

| | | | | |
|---|---|---|---|---|
| 2,426,328 | A * | 8/1947 | Wandel et al. | 300/21 |
| 5,007,686 | A * | 4/1991 | Klein et al. | 300/21 |
| 5,564,789 | A * | 10/1996 | Gerspacher | 300/21 |
| 5,588,714 | A * | 12/1996 | Boucherie | 300/21 |
| 5,593,213 | A * | 1/1997 | Meessmann | 300/21 |
| 6,322,152 | B2 | 11/2001 | Trojanowski et al. | |
| 6,871,373 | B2 | 3/2005 | Driesen et al. | |

FOREIGN PATENT DOCUMENTS

| | | | |
|---|---|---|---|
| BE | 900200 | A | 11/1984 |
| DE | 4009584 | A | 10/1991 |
| EP | 0078569 | A2 | 5/1983 |
| EP | 0779046 | * | 6/1997 |
| EP | 0779046 | A1 | 6/1997 |
| EP | 0779046 | B1 | 2/2000 |
| GB | 1599249 | * | 9/1981 |
| GB | 1599249 | A | 9/1981 |
| GB | 2110079 | * | 6/1983 |
| GB | 2110079 | A | 6/1983 |
| GB | 2146519 | A | 4/1985 |

OTHER PUBLICATIONS

European Search Report received in connection with European Application No. EP 04 00 1458, mailed on May 27, 2004, 1 page.
Office Action U.S. Appl. No. 11/489,905, Mailed Feb. 23, 2006.

* cited by examiner

*Primary Examiner*—David A Redding
(74) *Attorney, Agent, or Firm*—George H. Leal; Vladimir Vitenberg; David M. Weirich

(57) ABSTRACT

A method for making toothbrushes includes the steps of, providing a toothbrush, and providing an end-rounder secured to a support. The support is substantially fixed against movement. The toothbrush is moved towards the end-rounder such that free ends of bristles secured to a head of the toothbrush are rounded by the end-rounder.

3 Claims, 5 Drawing Sheets

METHOD AND APPARATUS FOR MAKING TOOTHBRUSHES

This application is a continuation of U.S. application Ser. No. 10/358,740, filed Feb. 5, 2003 now abandoned, which is incorporated herein by reference.

FIELD OF THE INVENTION

The invention relates generally to the field of toothbrushes, and in particular to toothbrush manufacturing.

BACKGROUND OF THE INVENTION

FIG. 1 discloses a preexisting apparatus for making (finishing) toothbrushes. Pairs of toothbrushes 10 are secured to blocks 12. The toothbrushes are in nearly their final state of manufacture at this point with bristles secured to the heads of the toothbrushes. A chain 14 periodically advances blocks 12 in the direction of an arrow 16.

A group of five cutters 18 are each used to trim or cut a subgroup of bristles on each brush to their specified length. A group of seven end-rounders 20 are used to round off the cut free ends of various subgroups of the bristles. Chain 14 advances all of toothbrushes 10 until they are properly positioned over a respective cutter or end-rounder.

A plow or fork (not shown) is then inserted into the bristles of some, but not all, of the toothbrushes which are adjacent to a cutter or end-rounder. The plow bends some of the bristles on a brush out of the way so that other bristles on the brush can be trimmed or end-rounded as the case may be. A platform (support) 22 is then raised to bring the cutters and end-rounders into contact with the bristles which are to be trimmed or end-rounded. It takes about 0.75 seconds to raise all the cutters and end-rounders.

After the bristles are trimmed or end-rounded, platform 22 is lowered to distance the cutters and end-rounders from the bristles. Chain 14 then advances to move the toothbrushes to the next cutter or end-rounder in the finishing process. Although not shown, after the toothbrushes receive a final-end-rounding at the right-most end-rounder in FIG. 1, they are removed from chain 14 and packaged. These toothbrushes are replaced in blocks 12 by new unfinished toothbrushes which have yet to be trimmed and end-rounded.

A problem with this arrangement is that during the time platform 22 is being raised and lowered, no end-rounding is being done on the bristles. Further, while chain 14 is advancing the toothbrushes into and out of a certain end-rounding station, no end-rounding is being done on the bristles. As a result, more aggressive end-rounding must be done during the limited time available to end-round the bristles. This requires plows (forks) to be inserted into the bristles at five of the seven end-rounding stations.

SUMMARY OF THE INVENTION

The present invention is directed to overcoming one or more of the problems set forth above. Briefly summarized, according to one aspect of the present invention, an apparatus for making toothbrushes includes an end-rounder for rounding the free ends of bristles secured to a head of a toothbrush. The end-rounder is secured to a support, the support being substantially fixed against movement.

According to another aspect of the invention, an additional end-rounder is included for rounding the ends of bristles secured to the head of the toothbrush. The additional end-rounder is secured to an additional support. The additional support is moveable alternately towards or away from the toothbrush to move the additional end-rounder towards or away from the toothbrush.

According to a further aspect of the invention, a cutter is provided for trimming the length of bristles on the toothbrush head prior to the ends of these bristles being rounded by the end-rounder. The cutter is moveable alternately towards or away from the toothbrush to move the cutter towards or away from the toothbrush.

These and other aspects, objects, features and advantages of the present invention will be more clearly understood and appreciated from a review of the following detailed description of the preferred embodiments and appended claims, and by reference to the accompanying drawings.

DETAILED DESCRIPTION OF THE INVENTION

Figure 1:
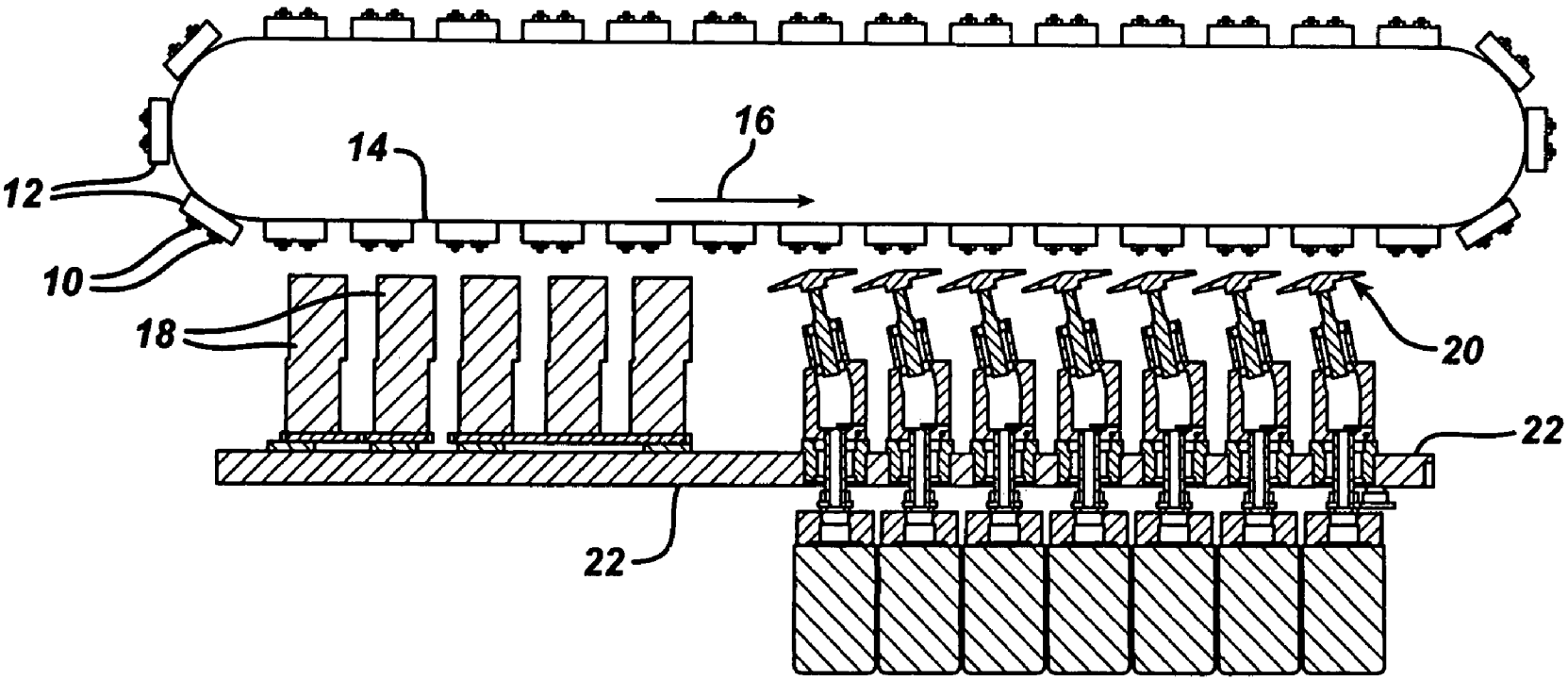
FIG. 1 (PRIOR ART)
FIG. 1 is a schematic side view of a pre-existing apparatus for making/finishing toothbrushes.
Figure 2:
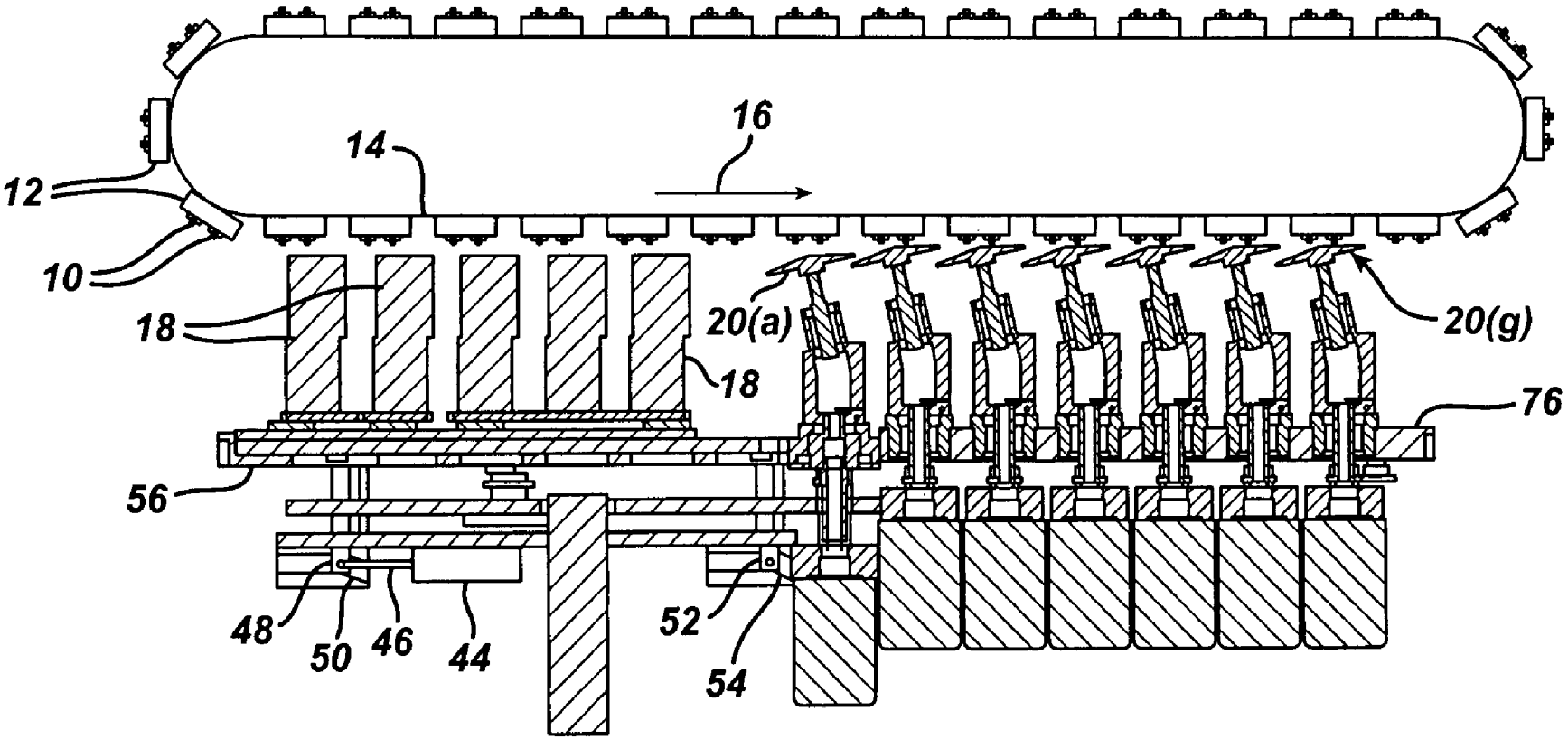
FIG. 2 is a schematic side view of an apparatus according to the invention for making/finishing toothbrushes.

Beginning with FIG. 2, reference numerals will be used that are similar to the reference numerals in FIG. 1 for those elements that are essentially the same. Pairs of toothbrushes 10 are secured to blocks 12. The toothbrushes are in nearly their final state of manufacture at this point with tufts of bristles secured to the heads of the toothbrushes. The bristle tufts may have various heights and orientations at this point.

A chain 14 periodically advances blocks 12 in the direction of an arrow 16. Each advance of chain 14 takes about 0.5 seconds. The chain stops moving when a pair of toothbrushes are adjacent to each of five cutters 18 and seven end-rounders 20(*a*)-(*g*). The cutters and end-rounders are constantly running. The bristles on each toothbrush adjacent a cutter or end-rounder are facing down towards the cutter or end-rounder.

Figure 3:
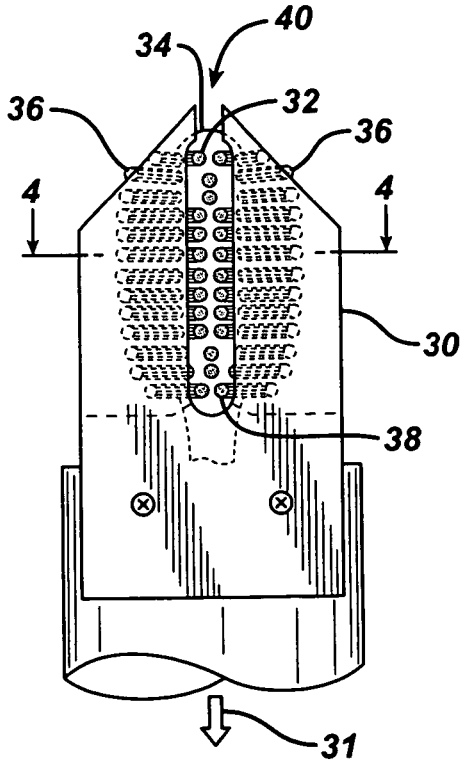
FIG. 3 is a bottom view of a bristle finishing fork inserted into a group of bristles.
Figure 4:
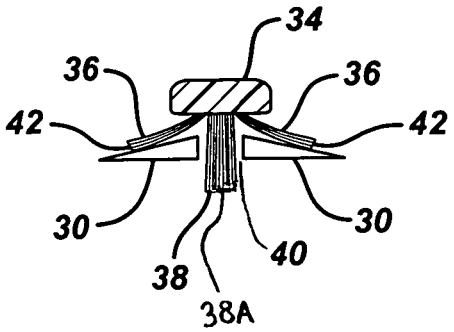
FIG. 4 is a sectional view of FIG. 3 taken along the lines 4-4 of FIG. 3.

Referring to FIGS. 3 and 4, a bristle finishing fork (or plow) 30 is now inserted opposite the direction of an arrow 31 into bristles 32 between head 34 of the toothbrush and a respective one of the cutters or end-rounders. The fork bends a first sub-group of bristles 36 to the side while allowing a second sub-group of bristles 38 to project through a gap 40 in the fork. This arrangement allows ends 38A of bristles 38 to be cut or end-rounded as the case may be while preventing ends 42 of bristles 36 from being cut or end-rounded.

Forks are used on the first three cutters the toothbrush encounters but not the last two cutters. This is the same as for the FIG. 1 apparatus. Forks are only required if it is necessary to prevent some bristles from being cut or end-rounded while other bristles are cut or end-rounded. This all depends on the final topography of the bristles desired.

Next, a pneumatic piston 44 is actuated to pull a piston rod 46 into the piston. This causes a cam follower 48 to move along a cam path 50. Cam follower 48 is also linked to a second cam follower 52 which likewise moves along another cam path 54. The motion of the cam followers causes a support 56 to move up about 7 mm in about 0.6 seconds. The five cutters and 1st end-rounder are connected to support 56 and likewise move up with the support. This motion causes designated bristles to come into contact with the cutters and end-rounders.

Figure 5:
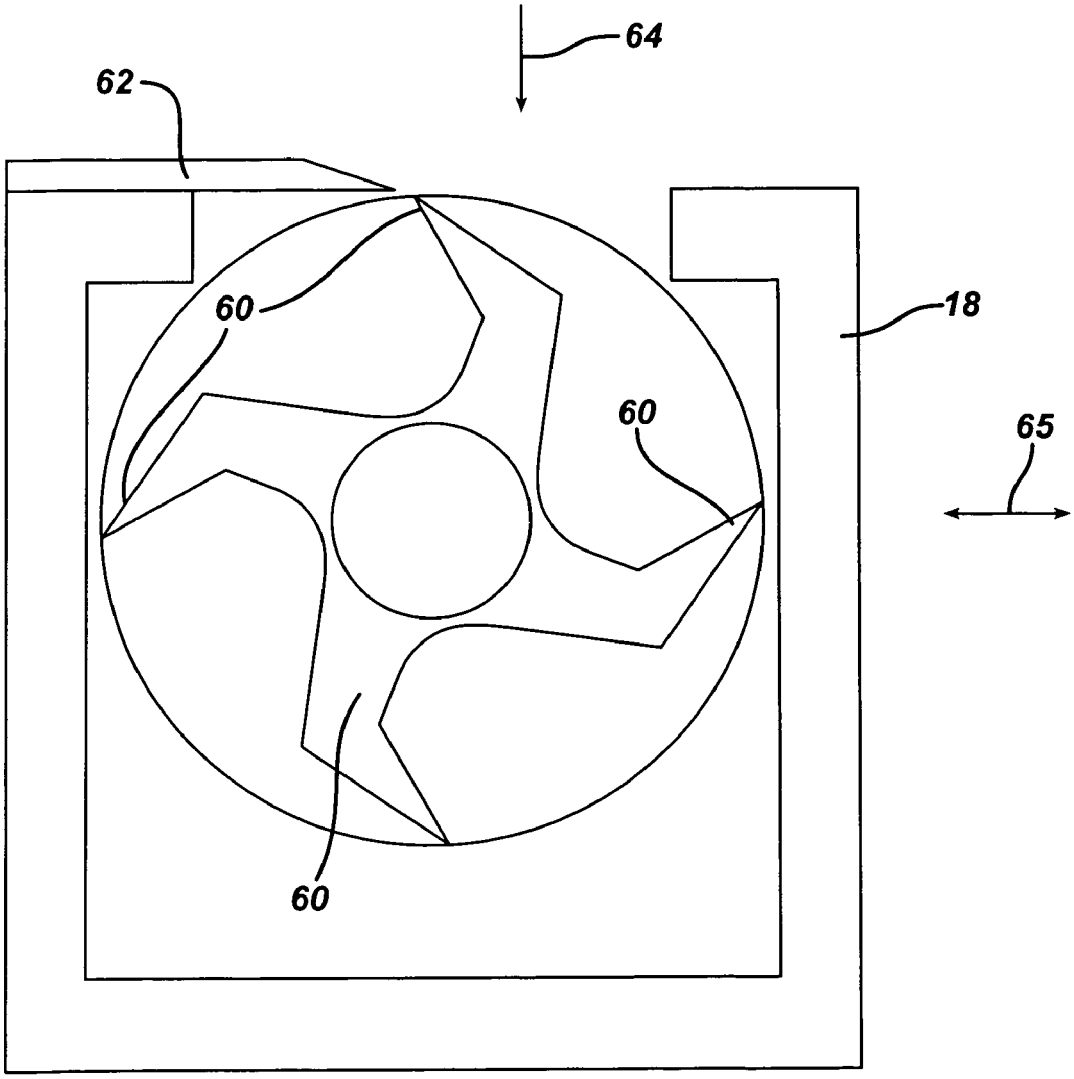
FIG. 5 is a sectional view of a cutter as looking into the paper on which FIG. 2 lies.

Turning now to FIG. 5, the operation of the cutters will be explained. Each cutter 18 includes four rotating trimmer blades 60 and a stationary counter blade 62. The act of raising support 56 causes bristles designated for cutting to move relative to cutter 18 in the direction of an arrow 64. After support 56 stops moving up, all of the cutters 18 are moved back and forth together in the direction of double-headed arrow 65. Each movement is about 2.5 inches and the cutters make about 5 cycles back and forth. This movement of the cutters allows the designated bristles of both toothbrushes presented to each cutter to be properly trimmed. The cutting operation takes about 4 seconds. The orientation and/or position of a cutter can be adjusted to alter the angle of cut on the bristles.

Figure 6:
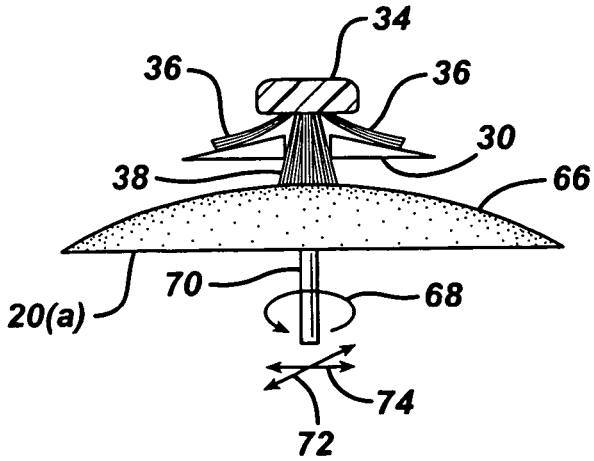
FIG. 6 is similar to FIG. 5 but also showing an end-rounder in operating position.

Referring to FIG. 6, end-rounder 20(*a*) is also raised on support 56. End rounder 20(*a*) includes a partial spherical surface 66 which has a roughened finish for abrading and rounding the free ends of bristles 38. The end-rounder is rotated in the direction of an arrow 68 about an axis 70. Axis 70 is also rotated about axes 72 and 74. The resultant motion results in what is called an orbital end-rounder. Further details on this type of end-rounder and on fork 30 can be found in U.S. Pat. No. 5,593,213.

The remaining end-rounders 20 (*b*)-(*g*) are not connected to support 56 and so do not move up or down with the support. Each end rounder 20(*b*)-(*g*) is connected to an additional support 76 which is substantially fixed against movement. As such, these six end-rounders are already in position to end-round when chain 14 starts moving the toothbrushes. After end-rounding and cutting is complete, piston 44 is actuated to lower support 56 and thus lower the five cutters and the first end-rounder. This lowering operation takes about 0.5 seconds.

Although not shown, after the toothbrushes receive a final-end-rounding at the right-most end-rounder 20(*g*), they are removed from chain 14 and packaged. These toothbrushes are replaced in blocks 12 by new unfinished toothbrushes which have yet to be trimmed and end-rounded.

There are a number of advantages to thus fixing the last six end-rounders in position. End-rounding can now be done while chain 14 is moving toothbrushes both into and out of a particular end-rounder, as well as during substantially all of the time support 56 is being raised and lowered. This adds about 1.5 more seconds of end rounding for each toothbrush at each of the six fixed end-rounders. Thus about nine more seconds of end-rounding are done on each brush. This additional end-rounding times allows end-rounding to be done less aggressively. As a result, none of end-rounders (*b*)-(*g*) require forks 30 to be used, resulting in a cost savings. In the system of FIG. 1, four of these six end-rounders required forks to be used. End-rounder 20(*a*) still requires a fork because it is end-rounding the shortest bristles on the toothbrush.

Another advantage is that support 56 can be raised faster because it is lifting only one end-rounder instead of seven end-rounders. As a result, support 56 can be raised in about 0.2 seconds.

Figure 7:
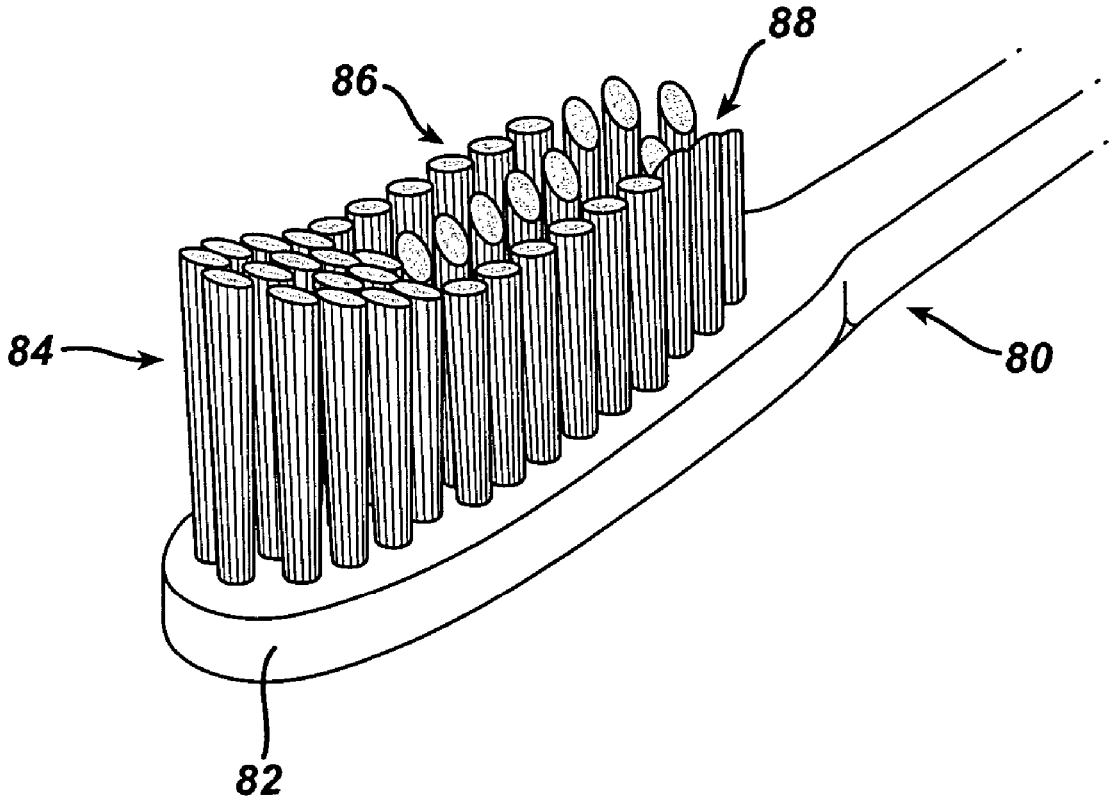
FIG. 7 is a perspective view of a bristle pattern on a toothbrush which can be made by the current invention.

FIG. 7 shows a toothbrush 80 which can be made by the method and apparatus described above. The bristle pattern is that of the Advantage® toothbrush sold by Oral-B®. Toothbrush 80 includes a head 82 from which extends a group of bristle tufts 84 known as a "power tip". The top surface of tufts 84 angles down towards head 82. Another group of bristle tufts 86 define a "V" or "U" shaped grove 88 known as an "action cup".

The invention has been described with reference to a preferred embodiment. However, it will be appreciated that variations and modifications can be effected by a person of ordinary skill in the art without departing from the scope of the invention.

What is claimed:

1. An apparatus for making toothbrushes, the apparatus comprising:

a first end-rounder for rounding the free ends of bristles secured to a head of a toothbrush, the first end-rounder being movable from a first position to a second position;

a second end-rounder for rounding the free ends of bristles secured to the head of the toothbrush, the second end-rounder being fixed in the first position;

a movable first support structure, wherein the first end-rounder is secured to the first support structure;

a stationary second support structure, wherein the second end-rounder is secured to the second support structure; and a plurality of cutters disposed upstream of the first and second end-rounders, wherein the plurality of cutters are connected to the first support structure.

2. The apparatus of claim 1 further comprising a fork which precludes the cutting and/or end-rounding of at least a portion of the free end of bristles.

3. The apparatus of claim 1 further comprising a fork which precludes the cutting of at least a portion of the free ends of bristles by at least a portion of the cutters.

* * * * *